US010222136B2

(12) United States Patent
Hoffmann et al.

(10) Patent No.: US 10,222,136 B2
(45) Date of Patent: Mar. 5, 2019

(54) RADIATOR FOR VEHICLE / COMBO COOLER FIN DESIGN

(71) Applicant: Hanon Systems, Daejeon (KR)

(72) Inventors: Christian Hoffmann, Neuss (DE); Josef Mahdal, Hluk (DE); Daniel Malovany, Hluk (DE)

(73) Assignee: HANON SYSTEMS, Daejeon (KR)

( * ) Notice: Subject to any disclaimer, the term of this patent is extended or adjusted under 35 U.S.C. 154(b) by 31 days.

(21) Appl. No.: 15/349,414

(22) Filed: Nov. 11, 2016

(65) Prior Publication Data

US 2017/0131038 A1 May 11, 2017

(30) Foreign Application Priority Data

Nov. 11, 2015 (DE) ..... 10 2015 119 408

(51) Int. Cl.

| | |
|---|---|
| ***F28F 1/04*** | (2006.01) |
| ***F28F 1/32*** | (2006.01) |
| ***F28D 1/04*** | (2006.01) |
| ***F28F 13/14*** | (2006.01) |
| *F28D 21/00* | (2006.01) |

(52) U.S. Cl.

CPC ..... *F28F 1/32* (2013.01); *F28D 1/0408* (2013.01); *F28F 13/14* (2013.01); *F28D 2021/0082* (2013.01); *F28D 2021/0094* (2013.01); *F28F 2215/04* (2013.01)

(58) Field of Classification Search

CPC ..... F28F 1/128; F28F 1/325; F28F 2215/02; F28F 2009/004; F28D 1/0435

USPC ..... 165/140

See application file for complete search history.

(56) References Cited

U.S. PATENT DOCUMENTS

| | | | | |
|---|---|---|---|---|
| 3,783,938 A | | 1/1974 | Chartet | |
| 4,693,307 A | * | 9/1987 | Scarselletta | F28F 1/128 165/152 |
| 5,033,540 A | * | 7/1991 | Tategami | F28D 1/0435 165/135 |
| 5,992,514 A | * | 11/1999 | Sugimoto | F28D 1/0435 165/135 |
| 6,170,565 B1 | | 1/2001 | Nishishita | |
| 6,209,628 B1 | * | 4/2001 | Sugimoto | F28D 1/0435 165/135 |
| 6,273,184 B1 | * | 8/2001 | Nishishita | F28D 1/0435 165/140 |
| 6,408,939 B1 | * | 6/2002 | Sugimoto | F28D 1/0435 165/135 |
| 2002/0017381 A1 | * | 2/2002 | Ozaki | F28D 1/0435 165/135 |

(Continued)

FOREIGN PATENT DOCUMENTS

| | | |
|---|---|---|
| DE | 102004051205 A1 | 5/2006 |
| JP | S62107273 U | 7/1987 |

(Continued)

*Primary Examiner* — Eric Ruppert

(74) *Attorney, Agent, or Firm* — Shumaker, Loop & Kendrick, LLP; James D. Miller

(57) ABSTRACT

A heat exchanger with multiple cooling circuits includes fins featuring at least two adjacent areas, a first one of the areas arranged in a first row of pipes and a second one of the areas arranged in a second row of pipes. A number of patterns are arranged in each of the areas. The number of patterns is determined by a specified heat transfer performance requirement for each of the areas.

6 Claims, 3 Drawing Sheets

(56) References Cited

U.S. PATENT DOCUMENTS

| | | | |
|---|---|---|---|
| 2010/0044013 | A1 | 2/2010 | Kim |
| 2014/0360705 | A1 | 12/2014 | Kim et al. |

FOREIGN PATENT DOCUMENTS

| | | | |
|---|---|---|---|
| JP | 2001330387 | A | 11/2001 |
| KR | 20070120263 | A | 12/2007 |
| WO | 2008125089 | A2 | 10/2008 |

* cited by examiner

RADIATOR FOR VEHICLE / COMBO COOLER FIN DESIGN

CROSS-REFERENCE TO RELATED PATENT APPLICATIONS

This patent application claims priority under 35 U.S.C. § 119 to German Patent Application No. 10 2015 119 408.2, filed on Nov. 11, 2015, in the German Intellectual Property Office, the disclosure of which is incorporated herein by reference in its entirety.

TECHNICAL FIELD

The invention relates to a heat exchanger with multiple cooling circuits, comprising at least a first and a second row of pipes which are arranged parallel to each other, with multiple cooling pipes arranged in the first and in the second row of pipes, respectively, the cooling pipes being flooded with a fluid intended for cooling associated with the respective cooling circuit, and with fins being arranged between the cooling pipes which are flooded with air and which extend at least across the cooling pipes of two adjacent rows of pipes.

BACKGROUND

For the cooling of internal combustion engines used, for instance, in motor vehicles, it is a matter of prior art to position a heat exchanger in the engine compartment of the motor vehicle. In this first cooling circuit, a cooling agent flows through the internal combustion engine, is heated up, and then cooled down again during its subsequent flow through the heat exchanger.

It is also a matter of prior art to position a second cooling circuit with a second heat exchanger in the engine compartment of the motor vehicle, for instance for the purpose of cooling a charge air cooler or an exhaust gas cooler.

Such heat exchangers generally consist of an inlet tank positioned on the input side, which are flooded with the cooling agent intended for cooling, and of an outlet tank positioned on the output side, from which the cooled cooling agent flows out after having flooded the heat exchanger. Typically, multiple pipes are arranged parallel to each other between the inlet tank and the outlet tank, which can be flooded by the cooling agent intended for cooling. Between these pipes, which may also be embodied as flat pipes, so-called fins are arranged, which can be flooded with air, in order to improve the heat dissipation. These fins can take a meandering form or a similar form, and may be brazed onto on or two adjacent pipes in the area of its curve. This creates a mechanically solid and heat-conducting connection between the fins and the pipes of the heat exchanger.

An arrangement of two heat exchangers with different performance requirements or heat transfer capacities is laborious since two separate systems must be integrated into the engine compartment, and furthermore, it significantly reduces the available construction volume in the engine compartment of a motor vehicle.

In order to reduce the construction volume needed for these two heat exchangers as well as production costs, it is also a matter of prior art to embody both heat exchangers in an integrated manner in a single physical unit. Such arrangements are also referred to as multiple-circuit multiple-row heat exchangers, since they feature multiple cooling circuits, and since these are arranged in at least two rows.

Typically, both heat exchangers are positioned with their rows of pipes serially in the air flow direction, so that an air flow serially flows through both rows of pipes of the heat exchanger.

From US Patent Application Publication No. 2014/0360705 A1, a heat exchanger is known featuring a first cooling circuit for the cooling of a first cooling fluid for the cooling of an internal combustion engine, and a second cooling circuit for the cooling of a second cooling fluent for the cooling of a charge air cooler. The cooling processes are performed in two separate spaced cooling systems each of which featuring multiple pipes flooded with a respective cooling agent, and fins arranged between these pipes. The cooling systems are arranged serially in the driving direction of a motor vehicle containing one of these cooling systems, such that the fins of both cooling systems are flooded sequentially by air.

It is disclosed that the fins extend either between the respective pipes of a cooling system, or between the pipes of the two cooling systems.

By combining two cooling systems within a so-called multiple-row heat exchanger, a better utilization of the space within the engine compartment of a motor vehicle is achieved. Furthermore, the parallel arrangement of the pipes and the fins improves the throughflow of the two cooling systems, reduces the aerodynamic drag of the outside air, and therefore improves the total heat dissipation function of the cooling systems.

The task of US Patent Application Publication No. 2010/0044013 A1 is to provide a heat exchanger for multiple cooling circuits which are easier, cheaper, and more simple to manufacture. For these purposes, two separate so-called core areas of a heat exchanger assembly are provided, each of which featuring a plurality of pipes and fins (cooling fins). The core areas are positioned in parallel and spaced from each other in the engine compartment of an internal combustion engine such that the fins can be flooded with air.

Depending on the construction and the manufacturing process, the heat exchangers are fitted with uniform fins in terms of their form, their extent, and their mutual spacing.

When a heat exchanger is flooded with a fluid such as air, this air flow experiences an aerodynamic drag. This brings about a difference between a fluid pressure ahead of and after the heat exchanger. This difference is also referred to a pressure drop or as a loss of air pressure.

In such multi-circuit and multi-row heat exchangers according to prior art, there is a disadvantage in that the possibilities of modifying, the heat exchangers that are operated independently from each other, to specific performance specifications while maintaining a specified maximum permitted loss of air pressure are limited.

The task of the invention is to provide a heat exchanger which allows for a flexible modification of the various performance specifications for different cooling circuits of the heat exchanger, and which is easy and cheap to manufacture.

SUMMARY OF THE INVENTION

The task is accomplished by way of a subject with the characteristics as disclosed herein.

The invention proposes a variation of the pattern on the fins, depending on the specified heat transfer performance requirements in individual areas or circuits of the heat exchanger. If such a heat transfer performance requirement is high, for instance, it is necessary to a large amount of heat from a cooling circuit via the heat exchanger, and vice versa.

The prior art arrangement of a fin across cooling pipes of one or several rows of pipes of a heat exchanger, where each row of pipes may belong to a different cooling circuit, is utilized in the invention.

In such fins, patterns are made that are meant to improve the functionality of the heat exchanger. These patterns are typically stamped or rolled into the fins. By way of these at least partial material fractures or air slits, the air can flow from the first side of the fin to the second side. These patterns may be embodied, for instance, in the form of an open window or of a hatch, and they may repeat themselves across the fin at regular intervals.

Rather by way of a modification known from prior art of the fin density, that is, of the mutual distance between two adjacent fins, in order to realize different heat transfer performance requirements, the invention suggests to modify the heat transfer of the fins by way of a modified application of the patterns in various areas of the fins (fin louvre pattern).

Typically, such patterns are designed such that the maximum possible heat transfer is guaranteed with a minimal use of material. This is related to a maximum loss of air pressure via the heat exchanger. According to the invention, the number of patterns that can be maximally applied in a certain area is reduced as needed, such that with a reduced number of patterns, the loss in air pressure is reduced as well. This way, the performance of individual areas or parts of areas of a fin, and therefore of individual cooling circuits, may vary at a constant fin density. The mesh depth remains small and has no negative impact on the feasibility in the row.

With a constant fin density, which determines the mutual distance between the fins, the patterns on the fins extending across multiple adjacent pipe rows is varied. Apart from size and form, the mutual distance between the patterns and the number of them on a fin or on a part of an area of a fin constitute the possible variation of the patterns.

Thus, for instance, it is provided that in a first partial area of the fin, in which there is a high heat transfer performance requirement, a larger or maximum possible number of patterns be placed on a fin.

In a second partial area with a low heat transfer performance requirement, only few or more widely spaced patterns are positioned.

Thus, a fin extending across multiple rows of pipes with different performance requirements can feature different heat transfer capacities in its various areas.

The number of partial areas of a fin is not limited to two. For instance, in case of a heat exchanger with parallel three rows of pipes, the fin is divided into three partial areas.

Advantageously, the number of partial areas on a fin corresponds to the number of the parallel rows of pipes of the heat exchanger.

The patterns that are meant to be arranged in a partial area of the fin may be positioned next to each other at an equal distance. Alternatively, the mutual distances between the patterns in a partial area may also depend on the number of patterns in the respective partial area. Thus, in case of an arrangement of few patterns in a partial area, larger distances may be selected, and an equal distribution of the patterns over the entire available area is possible.

In the alternative, the minimum distances between the patterns that are dictated by production needs can be maintained, such that the patterns are only applied in a section of the partial area, with the rest of the partial area being without patterns. In a further variant, such a group of patterns can be divided into two or more subgroups, which allows, for instance, for three groups of these patterns to be arranged in a partial area, without there being any patterns in the area between the groups.

It is advantageous to have partial areas of two adjacent fins feature the same fin pattern or the same number of patterns. This allows, for instance, for applying the maximum number of patterns on the first partial areas of the fins, whereas in the second and third partial areas of the fins, a reduced number of patterns is provided. The patterns in the second and third partial area may further be divided into two groups.

It is provided that the first row of pipes and the second row of pipes arranged adjacent to the first row of pipes are part of a first cooling circuit. In case of multi-circuit multi-row heat exchangers, two or more rows of pipes, which may be adjacent to each other, may be united to form a joint cooling circuit. A combination of multiple rows of pipes, for instance to form a cooling circuit of an internal combustion engine, may meet a high heat transfer performance requirement, allowing the heat exchanger to remain a compact and place-saving unit.

Thus, for instance, in a heat exchanger featuring three rows of pipes, the first and the second row of pipes may be part of a cooling circuit of an internal combustion engine, whereas the third row of pipes is assigned to a cooling circuit of a charge air cooler. A limitation of the number of rows of pipes or a fixed assignation of certain rows of pipes to specific cooling circuits is not specified by the present invention.

An embodiment in which the patterns in the fins have the same form and size, and in which the differences between the patterns are equal, may be advantageous in terms of the manufacturing of the fins. In principle, however, two adjacent patterns of the fin may feature different forms and dimensions, for instance in the event that such an embodiment would improve the flooding of the heat exchanger with air.

Also two adjacent groups with their respective patterns may be embodied either identically or differently in terms of the form and dimensions of the patterns.

It is provided that the patterns applied to the fins have the shape of a slightly opened hatch or door. Other forms, such as, for instance, a semi-circle, a triangle, a square, a rectangle, or other forms may be used as patterns as well.

BRIEF DESCRIPTION OF THE DRAWINGS

Further details, characteristics, and benefits of the embodiments of the invention derive from the following description of exemplary embodiments in reference to the respective drawings.

DETAILED DESCRIPTION OF EMBODIMENTS OF THE INVENTION

Figure 1:
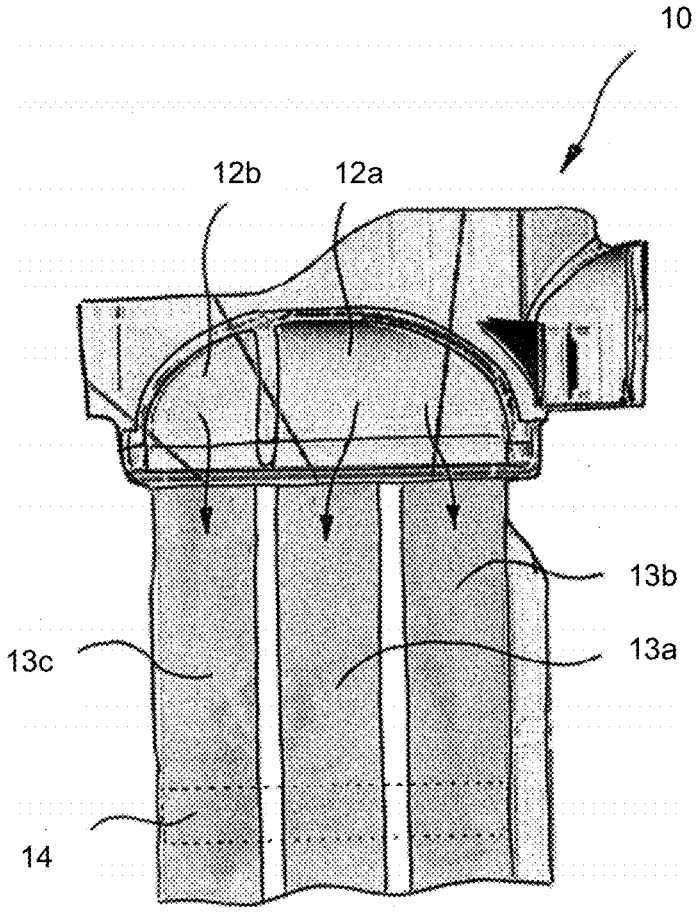
Prior Art Fig. 1
FIG. 1 shows a segment of a sectional view of a multi-circuit multi-row heat exchanger according to prior art.

FIG. 1 shows a segment of a sectional view of a heat exchanger 10 according to prior art. The image shows two inlet tanks 12*a* and 12*b*, separated from each other by a bridge, which are flooded by a cooling agent intended for cooling of a first coolant circuit and a second coolant circuit. In the example shown, the first coolant circuit of the heat exchanger 1 may be the cooling circuit for cooling an internal combustion engine, and the second coolant circuit may be a circuit for a charge air cooler.

The cooling agent of the first cooling circuit, which flows in via the first inlet tank 12*a*, is distributed over the two shown rows of pipes 13*a*, 13*b* of the first coolant circuit, floods them, and is cooled in the process. A first outlet tank positioned downstream from the rows of pipes 13*a*, 13*b*, via which the cooled cooling agent of the first coolant circuit exits the heat exchanger 10, is not shown.

The cooling agent of the second cooling circuit, which flows in via the second inlet tank 12*b*, is channeled via the shown row of pipes 13*c* of the second coolant circuit, floods it, and is cooled in the process. In this case, a second outlet tank positioned downstream from the row of pipes 13*c*, via which the cooled cooling agent of the second coolant circuit exits the heat exchanger 10, is not shown either.

It is provided that fins 14, which are typically positioned between the cooling pipes 13*a*, 13*b*, 13*c*, of which in FIG. 1 only a single fins 14 is exemplarily indicated by means of a dotted line, are embodied such that they extend across all three rows of pipes 13*a*, 13*b*, 13*c*. Such a construction of fins, for instance across two rows of pipes, is known from US Patent Application Publication No. 2014/0360705 A1.

In order to improve the heat exchange, so-called patterns 15 are applied to the fins 14. The patterns 15 are also known as fin louvre patterns or as air slits, and may be realized in by way of a partial material fractures or of a so-called stamped-in or rolled-in window.

The patterns 15 are typically applied over the length of the fin 14 in equal sizes and at equal distances to each other. According to the present invention, an adjustment of the patterns 15 on the fin 14 is implemented based on the specified heat transfer performance requirements for the various partial areas 16 of the fin 14.

Figure 2:
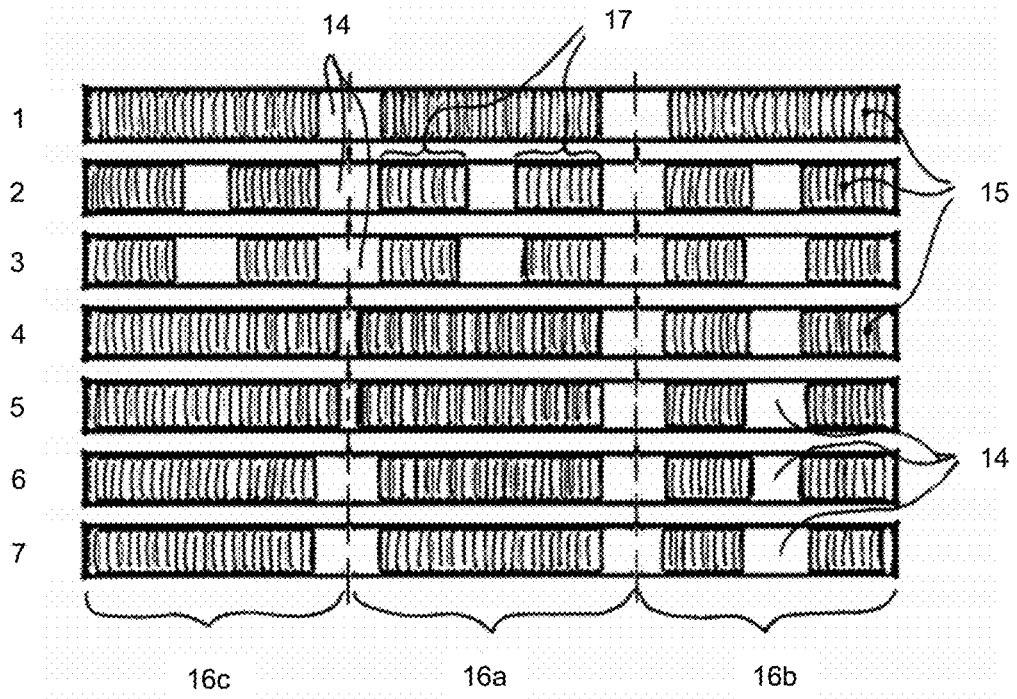
FIG. 2 shows multiple examples of fin patterns according to the invention.
Figure 3:
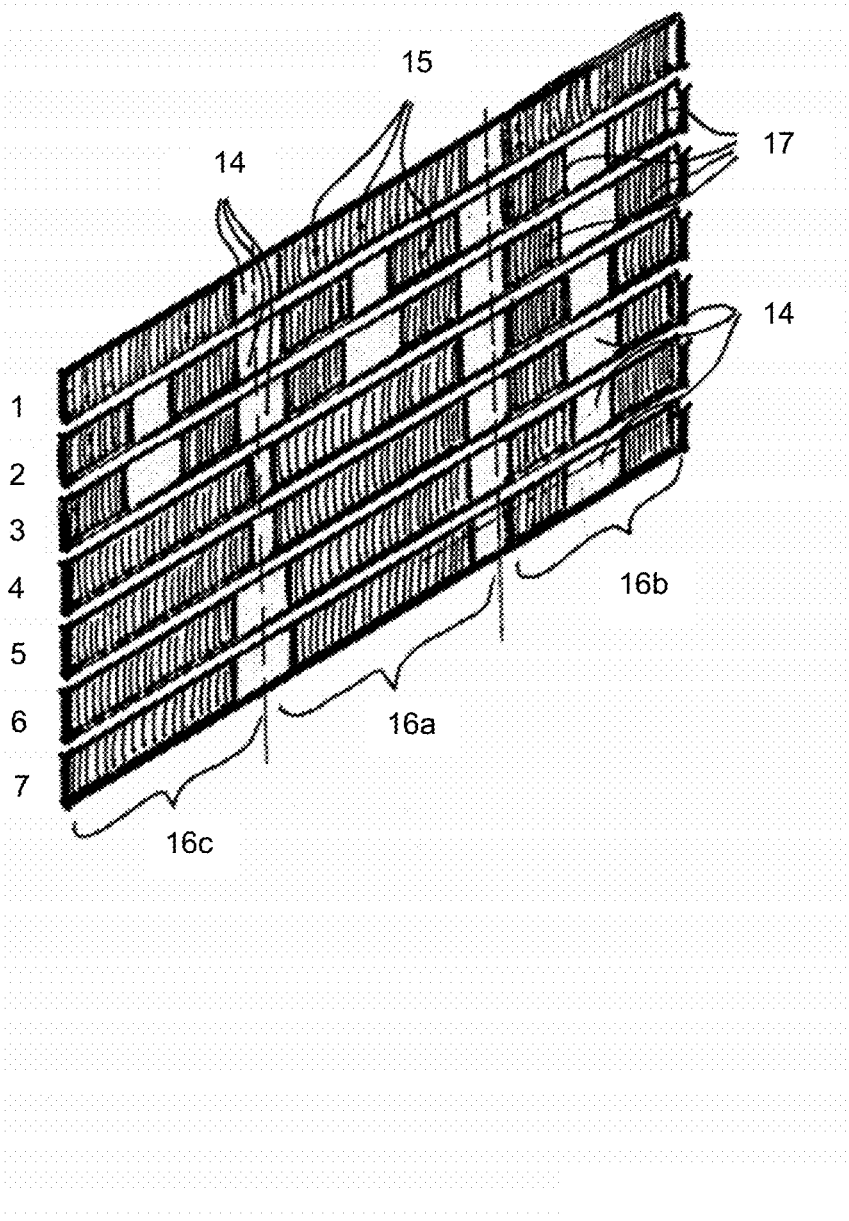
FIG. 3 shows a perspective view of various patterns on several fins.

In FIGS. 2 and 3, several examples are shown of the patterns 15 according to the invention on the fin 14. Displayed, arranged one below the other, are seven of the fins 14, the numbers 1 through 7 being a numbering of the exemplary patterns. Each of these fins 14 extends across three of the rows of pipes 13*a*, 13*b*, 13*c* of the multi-circuit multi-row heat exchanger 10, and in this example, therefore, features three different partial areas 16*a*, 16*b*, and 16*c*. Two of the partial areas 16*a*, 16*b* may be assigned to a first coolant circuit of an internal combustion engine, whereas the partial area 16*c* may be part of a cooling circuit of a charge air cooler. A limitation of such an arrangement or assignation is not given.

In exemplary pattern 1, of the very top fin 14, the heat transfer performance requirements in the partial areas 16*a*, 16*b*, 16*c* are equally high. For that reason, an equal number of the patterns 15 is applied in all three partial areas 16*a*, 16*b*, 16*c*, thereby accomplishing a maximum heat transfer capacity.

In exemplary pattern 2, the heat transfer performance requirements in all three partial areas 16*a*, 16*b*, 16*c* are lower than in the previous exemplary pattern. For that reason, the number of the patterns 15 needed in each of the partial areas 16*a*, 16*b*, 16*c* is lowered. This ensures that the required heat transfer capacities are realized. Furthermore, the reduction of the number of the patterns 15 reduces the loss of air pressure.

Since the number of the required patterns 15 is lower than in exemplary pattern 1, the patterns 15 will occupy a smaller part of the surface of the partial area 16*a*, 16*b*, or 16*c*. This allows for the possibility shown in exemplary pattern 2 in FIG. 2 of dividing the patterns 15 into two groups 17 for each of the partial areas 16*a*, 16*b*, 16*c*. An equal distribution of the number of the patterns 15 over the two groups 17 shown here is not mandatory.

A further reduction of the number of the patterns 15 necessitated by the further reduction of the performance requirements as compares to the exemplary pattern 2 is shown in the exemplary pattern 3.

In the exemplary patterns 4 through 7, the heat transfer performance requirements for the partial areas 16*a*, 16*b*, 16*c* are at least partially different. In the exemplary pattern 4, for instance, the performance requirements decrease from the partial area 16*c* via the partial area 16*a* to the partial area 16*b*, as do the numbers of the respectively applied patterns 15.

In the exemplary pattern 6, the performance requirements in the partial areas 16*a*, 16*c* are lower than in the exemplary pattern 5, whereas the performance requirement in the partial area 16*b* is higher. Accordingly, the partial areas 16*a*, 16*c* have less of the patterns 15, whereas the partial area 16*b* has more of the patterns 15.

In the exemplary pattern 7, the performance requirements in the partial areas 16*a*, 16*c* and the number of the patterns 15 correspond to those in the exemplary pattern 6, whereas the performance requirement and the number of the patterns 15 for the partial area 16*b* is identical to those in the exemplary pattern 5.

In the heat exchanger 10 with equally high performance requirements in all cooling circuits, multiple ones of the fins 14 as shown in exemplary pattern 1 may, for example, be arranged parallel to each other across the rows of pipes 13*a*, 13*b*, 13*c*. This parallel arrangement of the fins 14 will be made in the typical density of the fins 14.

In the heat exchanger 10 in which different performance requirements are specified for the cooling circuits, the fins 14 shown in the exemplary pattern 4 may be used.

For a better illustration, the exemplary patterns 1 through 7 for the fins 14 shown in FIG. 2 are shown in a perspectival view.

The invention provides the heat exchanger 10 with a low construction volume and with a low weight. Furthermore, the costs of manufacturing and assembling the heat exchanger 10 remain low, as no additional components are required.

REFERENCE LIST

10 heat exchanger
12*a*, 12*b*, 12*c* inlet tank
13, 13*a*, 13*b*, 13*c* rows of pipes
14 fins
15 patterns/air slits
16, 16*a*, 16*b*, 16*c* partial areas
17 groups

What is claimed is:

1. A heat exchanger with a plurality of cooling circuits, the heat exchanger comprising:

a first row of pipes;

a second row of pipes disposed parallel to and adjacent the first row of pipes;

a third row of pipes disposed parallel to and adjacent the second row of pipes, each of the first row of pipes, the second row of pipes, and the third row of pipes having a plurality of cooling pipes disposed therein; the plurality of cooling pipes of the first row of pipes, the plurality of cooling pipes of the second row of pipes, and the plurality of cooling pipes of the third row of pipes flooded with a fluid configured for cooling at least one of the plurality of cooling circuits, wherein each of the first row of pipes and the second row of pipes is connected to a first one of the plurality of cooling circuits and the third row of pipes is connected to a second one of the plurality of cooling circuits, wherein the second one of the plurality of cooling circuits operates at a different temperature than the first one of the plurality of cooling circuits; and a plurality of fins disposed between the plurality of cooling pipes of each of the first row of pipes, the second row of pipes, and the third row of pipes, each of the plurality of fins flooded with air and extending across one of the plurality of cooling pipes of the first row of pipes, one of the plurality of cooling pipes of the second row of pipes, and one of the plurality of cooling pipes of the third row of pipes, each of the plurality of fins having three adjacent areas, a first one of the areas disposed in the first row of pipes, a second one of the areas disposed in the second row of pipes, and a third one of the areas disposed in the third row of pipes, each of the areas including a plurality of patterns, wherein each of the patterns is a slit formed in one of the plurality of fins and wherein a number of the patterns present on each of the areas selectively corresponds to a heat transfer performance requirement for the respective one of the areas, wherein the number of the patterns present on the first one of the areas is fewer than the number of the patterns present on the second one of the areas, and wherein the number of the patterns present on the second one of the areas is fewer than the number of the patterns present on the third one of the areas.

2. The heat exchanger according to claim 1, wherein the patterns present on each of the areas are divided to be arranged into at least two groups.

3. The heat exchanger according to claim 1, wherein adjacent ones of the plurality of fins are connected to a same one of the plurality of cooling pipes, and wherein the patterns of a first one of the adjacent ones of the plurality of fins corresponds to the patterns of a second one of the adjacent ones of the plurality of fins.

4. The heat exchanger according to claim 1, wherein the patterns of the first one of the areas of one of the plurality of fins has have different forms and dimensions from the patterns of the second one of the areas of the one of the plurality of fins.

5. The heat exchanger according to claim 4, wherein the patterns of one of the areas is divided into a plurality of groups, and wherein the patterns of two adjacent ones of the plurality of groups have different forms and dimensions from each other.

6. The heat exchanger according to claim 1, wherein the first one of the cooling circuits exchanges heat with an internal combustion engine of a vehicle and wherein the second one of the cooling circuits exchanges heat with one of a charge air cooler of the vehicle or an exhaust gas cooler of the vehicle.

* * * * *